US007604489B2

(12) United States Patent
Shuey et al.

(10) Patent No.: US 7,604,489 B2
(45) Date of Patent: Oct. 20, 2009

(54) μTCA-COMPLIANT POWER CONTACTS

(75) Inventors: Joseph B. Shuey, Camp Hill, PA (US); Stuart C. Stoner, Lewisberry, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/939,009

(22) Filed: Nov. 13, 2007

(65) Prior Publication Data

US 2009/0124140 A1 May 14, 2009

(51) Int. Cl.
*H01R 12/00* (2006.01)

(52) U.S. Cl. ..... 439/79; 439/845; 439/947

(58) Field of Classification Search ..... 439/79, 439/381, 733.1, 845, 850, 884, 947
See application file for complete search history.

(56) References Cited

U.S. PATENT DOCUMENTS

| | | | | |
|---|---|---|---|---|
| 2,579,739 | A | 12/1951 | Hayes | |
| 2,744,244 | A | 5/1956 | Schumacher | |
| 2,816,275 | A | 12/1957 | Hammell | |
| 2,974,302 | A | 3/1961 | Ellis | |
| 3,514,740 | A | 5/1970 | Filson | |
| 4,353,609 | A * | 10/1982 | Haas | 439/82 |
| 5,158,471 | A * | 10/1992 | Fedder et al. | 439/80 |
| 5,582,519 | A | 12/1996 | Buchter | |
| 5,630,720 | A * | 5/1997 | Kocher | 439/78 |
| 5,667,392 | A | 9/1997 | Kocher et al. | |
| 6,056,603 | A * | 5/2000 | Pauza | 439/733.1 |
| 6,299,492 | B1 | 10/2001 | Pierini et al. | |
| 6,454,575 | B1 * | 9/2002 | Jones et al. | 439/79 |
| 6,814,590 | B2 | 11/2004 | Minich et al. | |
| 6,846,206 | B2 * | 1/2005 | Kling et al. | 439/884 |
| 7,258,562 | B2 | 8/2007 | Daily et al. | |
| 7,335,043 | B2 | 2/2008 | Ngo et al. | |
| 2002/0193019 | A1 | 12/2002 | Blanchfield et al. | |
| 2003/0143894 | A1 | 7/2003 | Kline et al. | |
| 2005/0118846 | A1 | 6/2005 | Clark | |

FOREIGN PATENT DOCUMENTS

| | | |
|---|---|---|
| WO | WO03/065511 A2 | 8/2003 |

* cited by examiner

*Primary Examiner*—Khiem Nguyen
(74) *Attorney, Agent, or Firm*—Woodcock Washburn LLP

(57) ABSTRACT

Disclosed are blade contacts that may be suitable for mating with μTCA-standard receptacle contacts. Such a blade contact may define a body portion, and a tab portion extending from a mating end of the body portion. The tab portion may be a tapered tab portion that tapers from a first width at the mating end of the body portion to a second, lesser width at a distal end of the tab portion. The body portion may define a single beam portion from which the tab portion and one or more terminal pins extend. Alternatively, the body portion may define a first beam portion from which the tab portion extends, and a second beam portion from which the terminal pins extend. Thus, the body portion may be generally L-shaped. Electrical connectors including such contacts are also disclosed.

48 Claims, 6 Drawing Sheets

μTCA-COMPLIANT POWER CONTACTS

FIELD OF THE INVENTION

The invention relates generally to power contacts. More particularly, the invention relates to power contacts that may be suitable for mating with μTCA-standard receptacle contacts.

BACKGROUND OF THE INVENTION

Power contacts are well-known for use in electrical and computing systems. μTCA is an industry standard that was developed for power contacts, and for the electrical connectors that include them. According to μTCA, contact, housing, and connector designs may be optimized to achieve design objectives for power density and functional integration, while allowing for low-cost manufacturing. Because μTCA is widely used in the power industry, it would be desirable if there were available additional contact configurations and electrical connectors that comply with the standard.

SUMMARY OF THE INVENTION

Disclosed herein are blade contacts that may be suitable for use as power contacts in compliance with μTCA. Such contacts may be suitable for mating with μTCA-standard receptacle contacts.

An example embodiment of such a blade contact may define a body portion having a mating end and a mounting end. A tab portion may extend from the mating end of the body portion. The tab portion may be a tapered tab portion, having a first width at the mating end of the body portion and a second width at a distal end of the tab portion. The second width may be less than the first width.

One or more terminal pins may extend from the mounting end of the body portion. Such terminal pins may be suitable for electrical connection to a substrate, such as a printed circuit board, for example. The body portion may define a single beam portion from which both the tab portion and the terminal pins extend. The terminal pins may extend in a direction perpendicular to the direction along which the beam portion extends. Alternatively, the body portion may define a first beam portion from which the tab portion extends, and a second beam portion from which the terminal pins extend. The second beam portion may be perpendicular to the first beam portion. Thus, the body portion may be generally L-shaped.

Electrical connectors including such contacts are also disclosed.

DETAILED DESCRIPTION

Figure 1:
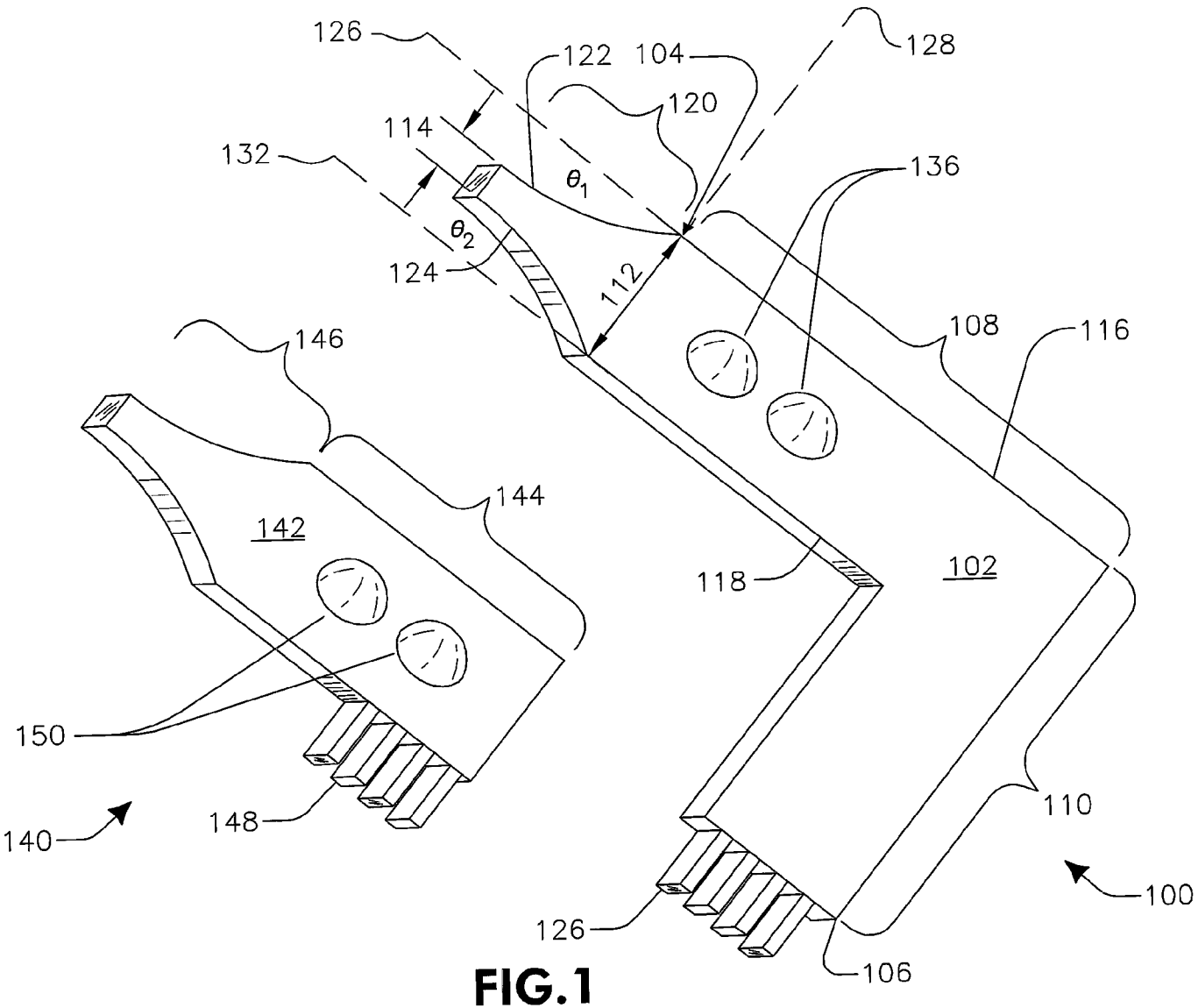
FIG. 1 depicts a pair of example power contacts according to one aspect of the invention.

FIG. 1 depicts a pair of example power contacts 100, 140 according to one aspect of the invention that may mate with receptacle contacts that comply with the Micro Telecommunications Architecture (μTCA) standard(s). The outer power contact 100 may include a body portion 102 having a mating end 104 and a mounting end 106. The mating end 104 may be received by a complementary contact such as a receptacle contact.

A first beam 108 of the power contact 100 may extend along the body portion 102 in a first direction. A second beam 110 may extend from the first beam in a second direction. Thus, the body portion 102 may be L-shaped. Such an embodiment may be contained in a right angle connector. The distal end of the first beam 108 may define the mating end 104 of the body portion 102. The distal end of the second beam 110 may define the mounting end 106 of the body portion 102.

A tab portion 120 may extend from the first end of the body portion 102. The tab portion 120 may have opposing walls 122 and 124. The distance between the proximal ends of the opposing walls 122 and 124 may define the first width 112 of the tab portion 120. The body portion 102 may define first and second opposing edges, 116 and 118, respectively. The opposing edges 116 and 118 may be substantially parallel to each other. The first width 112 of the tab portion 120 may be equal to the distance between the first edge 116 and the second edge 118. Such a first width 112 may be approximately 6 mm, for example. However, the first width 112 of the tab portion 120 may be wider or narrower than the distance between opposing edges 116 and 118.

The distal end of the tab portion 120 may terminate in a second width 114. The second width may be approximately 2 mm, for example. Thus the tab portion 120 may have a relatively wider first width 112 that terminates in a relatively narrower second width 114. The tab portion 120 may extend approximately 7.74 mm from the first beam 108.

The tab portion 120 may be a tapered tab portion 120, wherein the tab portion 120 tapers from the first width 112 to the second width 114. Angles $\theta_1$ and $\theta_2$ are the taper angles of the tab portion 120. The outer wall 122 of the tab portion 120 may form angle $\theta_1$, with axis 126. The orientation of axis 126 may be longitudinal along the length of the first beam 108. An axis 128 may be drawn orthogonal to the axis represented by 126. The origin of axes 126 and 128 may be at the intersection of the proximal end of the outer wall 122 of the tab portion 120 and the distal end of edge 116. Similarly, the outer wall 124 of the tab portion 120 forms an angle $\theta_2$, with axis 132. Axes 126 and 132, respectively, may extend longitudinally along the same direction as the length of the first beam 108 of the body portion 102.

The taper of the tapered tab portion 120 may be a curvilinear taper. That is, the outer walls 122 and 124 may be characterized by a curved line extending from the wide end 112 of the tab portion 120 to the narrow end 114 of the tab portion 120. Such a tapered tab portion 120 is shown in FIG. 1. The taper may also be a linear taper, in which the outer walls 122 and 124 extend linearly or straight from the proximal end to the distal end of the tab portion 120.

The example power contact 100 of FIG. 1 includes a second beam 110 that may extend from the body portion 102 in a different direction than the first beam 108. Terminal portions 126 may extend from the second beam 110. The second beam 110 may extend from the first beam 108 in a direction perpendicular to the first beam 108. Thus, the terminal portions 126 may extend from the second beam 110 in a direction perpendicular to the tab portion 120. The power contact 100 may be disposed in a right angle connector for electrically connecting substrates that are positioned in right angles to each other. However, the second beam 110 may be at any angle to the first beam 108 or the power contact 100 may be straight. Thus, terminal portions 126 may extend from body portion 102 in any direction with respect to the tab portion 120.

The terminal portions 126 may be suitable for electrical connection to a substrate, such as a printed circuit board, for example. The terminal portions 126 may be designed for electrical connection in a variety of ways. For example, the terminal portions 126 may be fusible elements (e.g. balls) or pins (e.g. through-hole pins, solder-to-board pins, press-fit pins, surface mount pins).

A retention boss 136 may be disposed on the body portion 102. The retention boss 136 may be a protrusion or an indentation. The retention boss may be stamped into the body portion 102 such that the retention boss 128 is an indentation on one side and a protrusion on the opposing side of the body portion 102. Alternatively, the indentation or protrusion may be formed on only one side of the body portion 102.

There may be one or more retention bosses 136 disposed on the first beam 108 of the body portion 102 of the power contact 100. For example, FIG. 1 depicts two retention bosses 136 disposed on the first beam 108 extending from the body portion 102. The retention bosses 136 may aid the insertion of the power contact 100 into a connector housing. For example, the retention boss 136 may push against an interior wall of the electrical connector housing so as to create a close-fit between the power contact 100 and the connector housing. The retention bosses 136 may be covered in plastic.

Other geometries may be employed for the power contact 100. For example, opposing edges 116 and 118 may terminate at varying lengths. The opposing edges 116 and 118 may not be parallel to each other. The angles $\theta_1$ and $\theta_2$, may be different, resulting in different taper angles of walls 122 and 124.

Another embodiment of the power contacts described herein is the second power contact 140 shown in FIG. 1. In this example power contact 140, the body portion 142 may define a single beam portion 144 from which both the tab portion 146 and the terminal portions 148 extend. One or more terminal portions 148 may extend from the single beam 144. The terminal portions 148 are shown extending in a direction perpendicular to the direction along which the tab portion 146 extends. However, the terminal portions 146 may extend in any suitable direction from the single beam 144 of the power contact 140. For example, the terminal portions 146 may extend in a direction opposite to the tab portion 146, thereby enabling the power contact 140 to be utilized in a mezzanine connector assembly. FIG. 1 depicts two retention bosses 150 disposed on each the body portion 142.

Figure 2A:
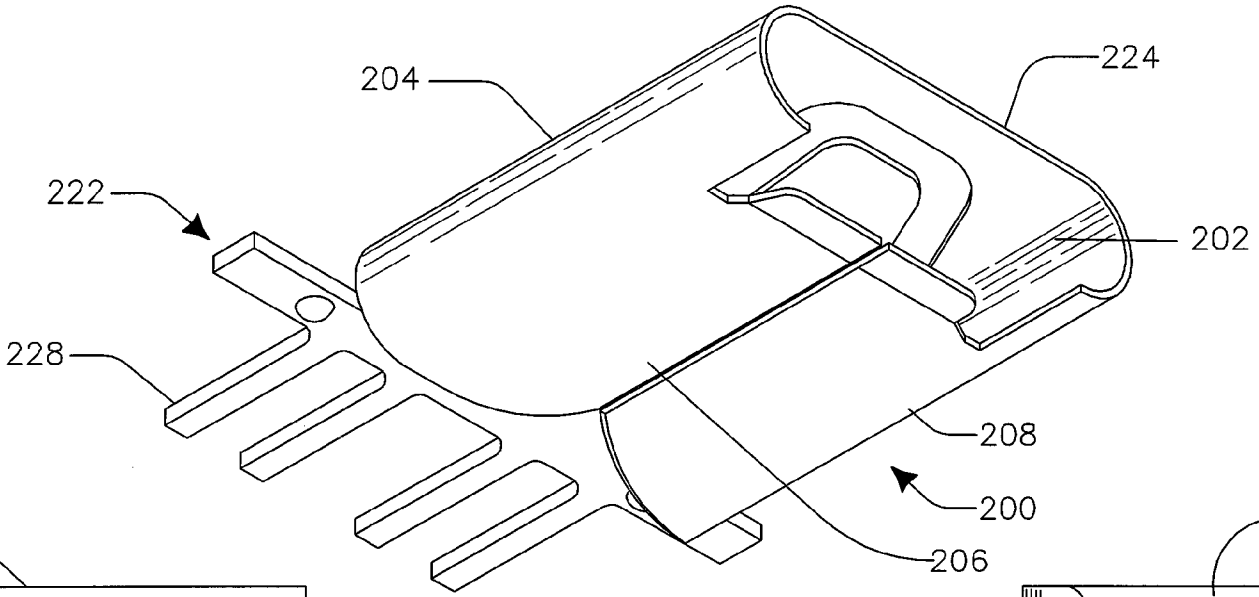
FIGS. 2A-2C depict, respectively, perspective, top, and bottom views of an example μTCA-compliant receptacle contact.
Figure 2C:
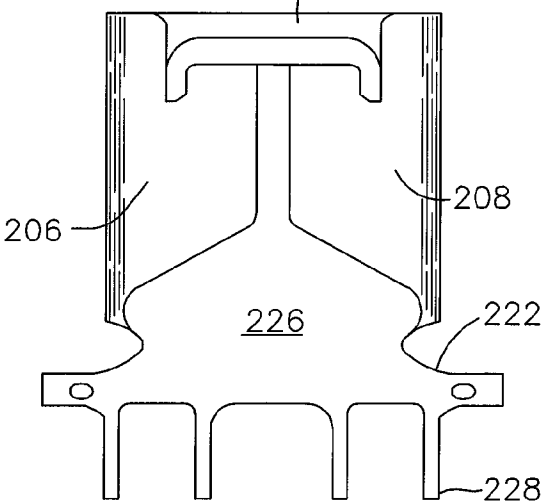
Figure 2B:
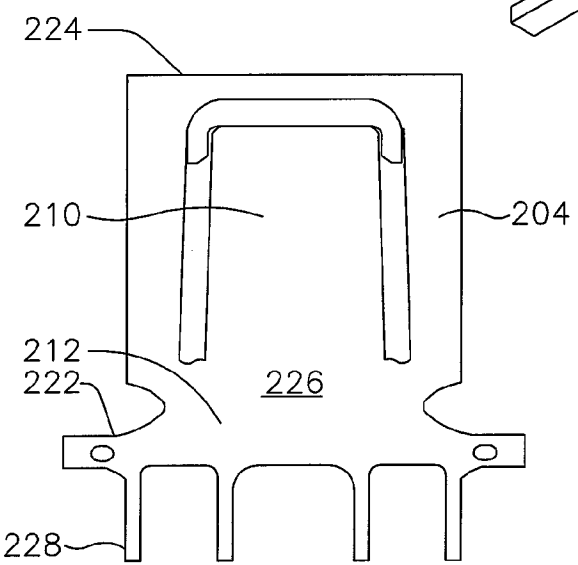

FIGS. 2A-2C depict, respectively, perspective, top, and bottom views of an example μTCA-compliant receptacle contact. The receptacle contact 200 may include a main body 226. The main body 226 of the receptacle contact 200 has a mating end 224 and a mounting end 222. The mating end 224 may be adapted to mate with another electrical contact such as one of the power contacts 100, 140. The mounting end may include tail portions 228 for connection to a substrate.

A mating end of a complementary contact may be received into a contact receiving space 202 at the mating end 224 of the receptacle contact 200. The contact receiving space 202 may be defined by the outer walls 204, 206, 208. The contact receiving space 202 may extend through the main body 226 of the receptacle contact.

Figure 4A:
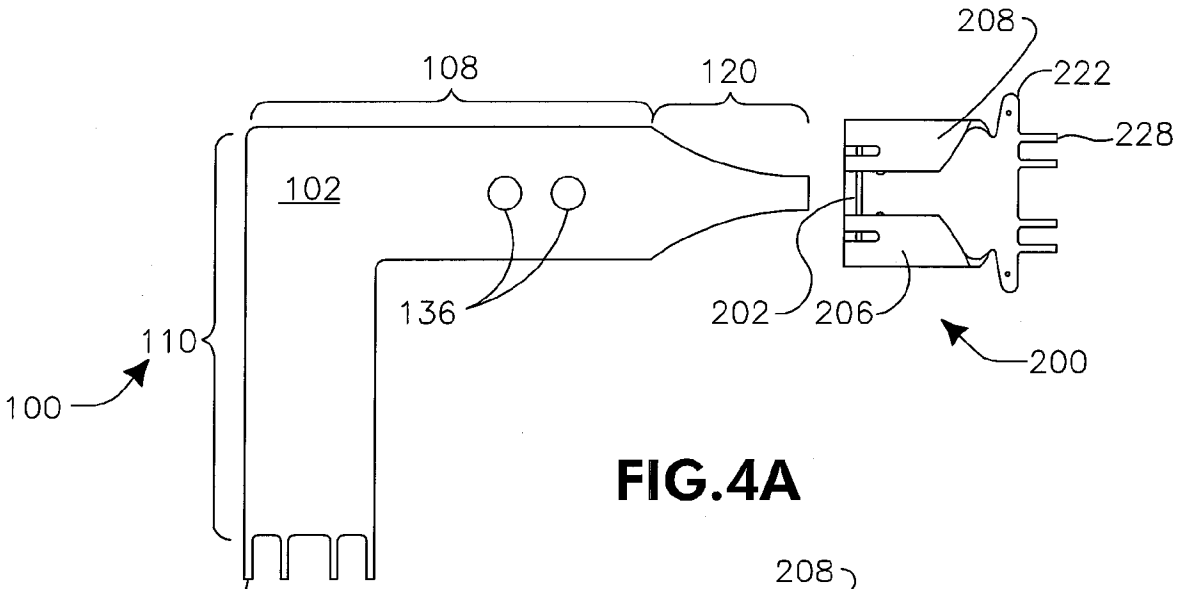
FIGS. 4A and 4B depict an example receptacle contact receiving a power contact.
Figure 4B:
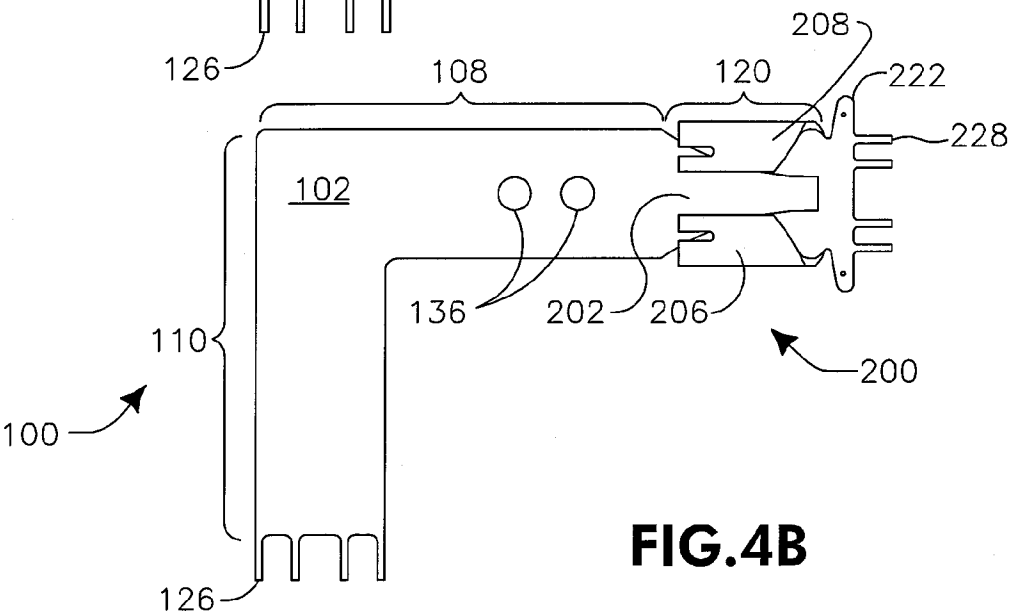

The tab portion 120, 146 of the power contacts 100, 140 shown in FIG. 1 may be inserted into the contact receiving space 202, as further shown in FIG. 4B. The rear wall 204 of the main body 226 may include a contact spring arm 210 that extends from the base 212 of the receptacle contact. The contact spring arm 210 may be depressed slightly inward and may be adapted to outwardly flex when a mating contact is inserted into the contact receiving space 202.

Figure 3A:
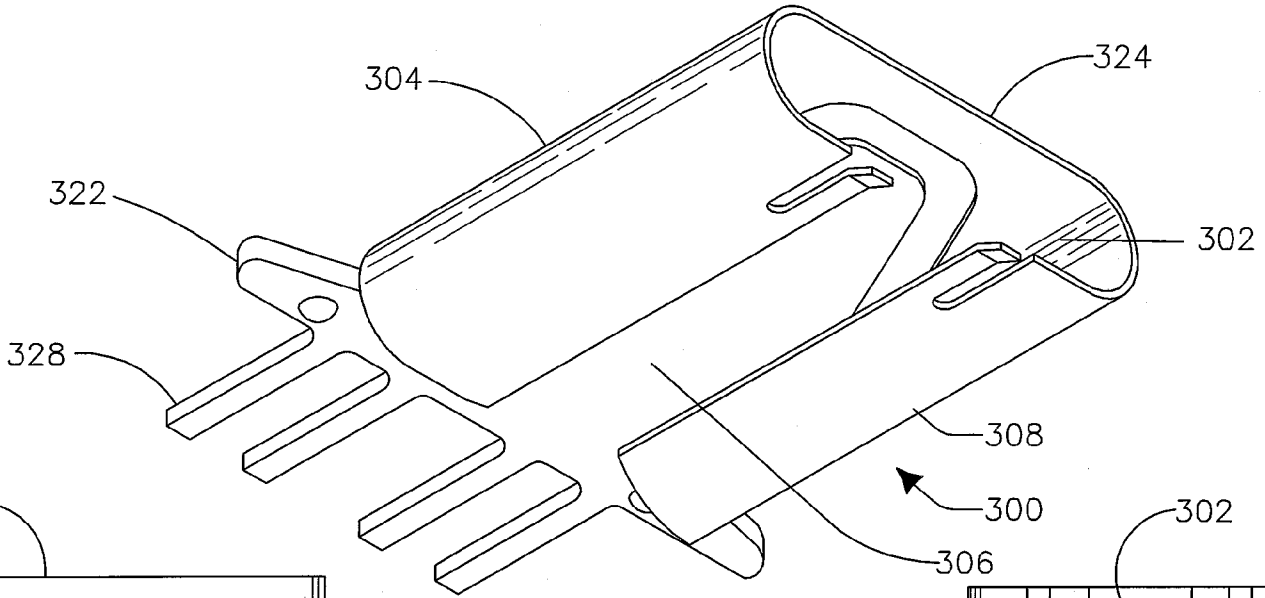
FIGS. 3A-3C depict, respectively, perspective, top, and bottom views of an alternative example μTCA-compliant receptacle contact.
Figure 3C:
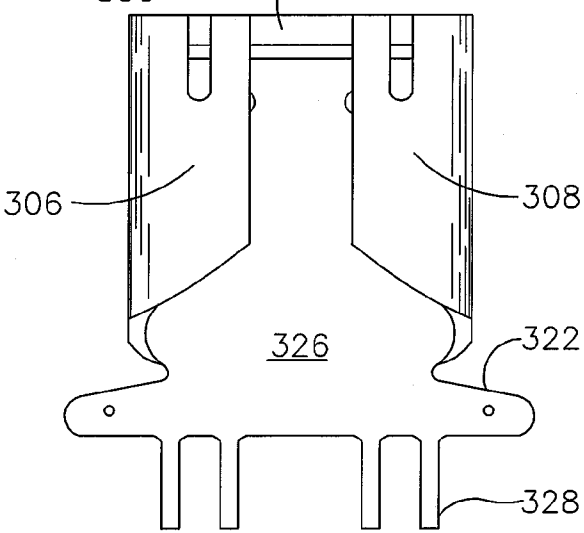
Figure 3B:
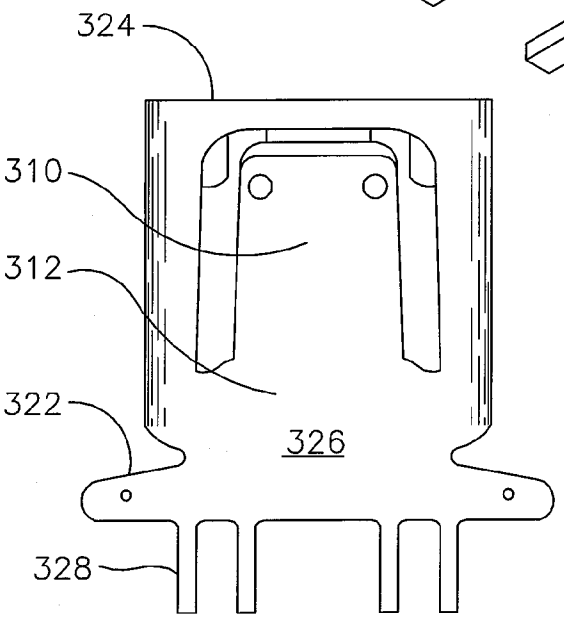

FIGS. 3A-3C depict, respectively, perspective, top, and bottom views of an alternative example μTCA-compliant receptacle contact. The receptacle contact 300 may include a main body 326. The main body 326 of the receptacle contact 300 has a mating end 324 and a mounting end 322. The mating end 324 may be adapted to mate with another electrical contact such as one of the power contacts 100, 140. The mounting end may include tail portions 328 for connection to a substrate. Each of the tail portions 328 may have a different spacing between them as compared to the tail portions 228 of the receptacle contact 200.

A mating end of a complementary contact may be received into a contact receiving space 302 at the mating end 324 of the receptacle contact 300. The contact receiving space 302 may be defined by the outer walls 304, 306, 308. A distance between the walls 306, 308 may be greater than the distance between walls 206, 208 of the receptacle contact 200. The contact receiving space 302 may extend through the main body 326 of the receptacle contact.

The tab portion 120, 146 of the power contacts 100, 140 shown in FIG. 1 may be inserted into the contact receiving space 302. The rear wall 304 of the main body 326 may include a contact spring arm 310 that extends from the base 312 of the receptacle contact. The contact spring arm 310 may be depressed slightly inward and may be adapted to outwardly flex when a mating contact is inserted into the contact receiving space 302.

FIG. 4A depicts the power contact 100 and the receptacle contact 200 prior to insertion of the power contact 100 into the receptacle contact 200. The example power contact 100 shown is power contact 100 of FIG. 1, and the example receptacle contact 200 shown is the receptacle contact 200 of FIGS. 2A-2C. Of course, the power contact 140 of FIG. 1 and/or the receptacle contact 300 of FIGS. 3A-3C may be similarly described.

FIG. 4B depicts the tapered tab portion 120 of the power contact 100 inserted into the contact receiving area 202 of the receptacle contact 200. The depth of insertion of the tab portion 120 into the receptacle contact 200 may vary with the width of the tab portion 120 or size of the contact receiving area 202. The depth of insertion may also depend on the connector housings of the respective power and receptacle connectors that include, respectively, the power contact 100 and the receptacle contact 200. That is, the housings of the connectors may abut and act as a stop during insertion.

Figure 5:
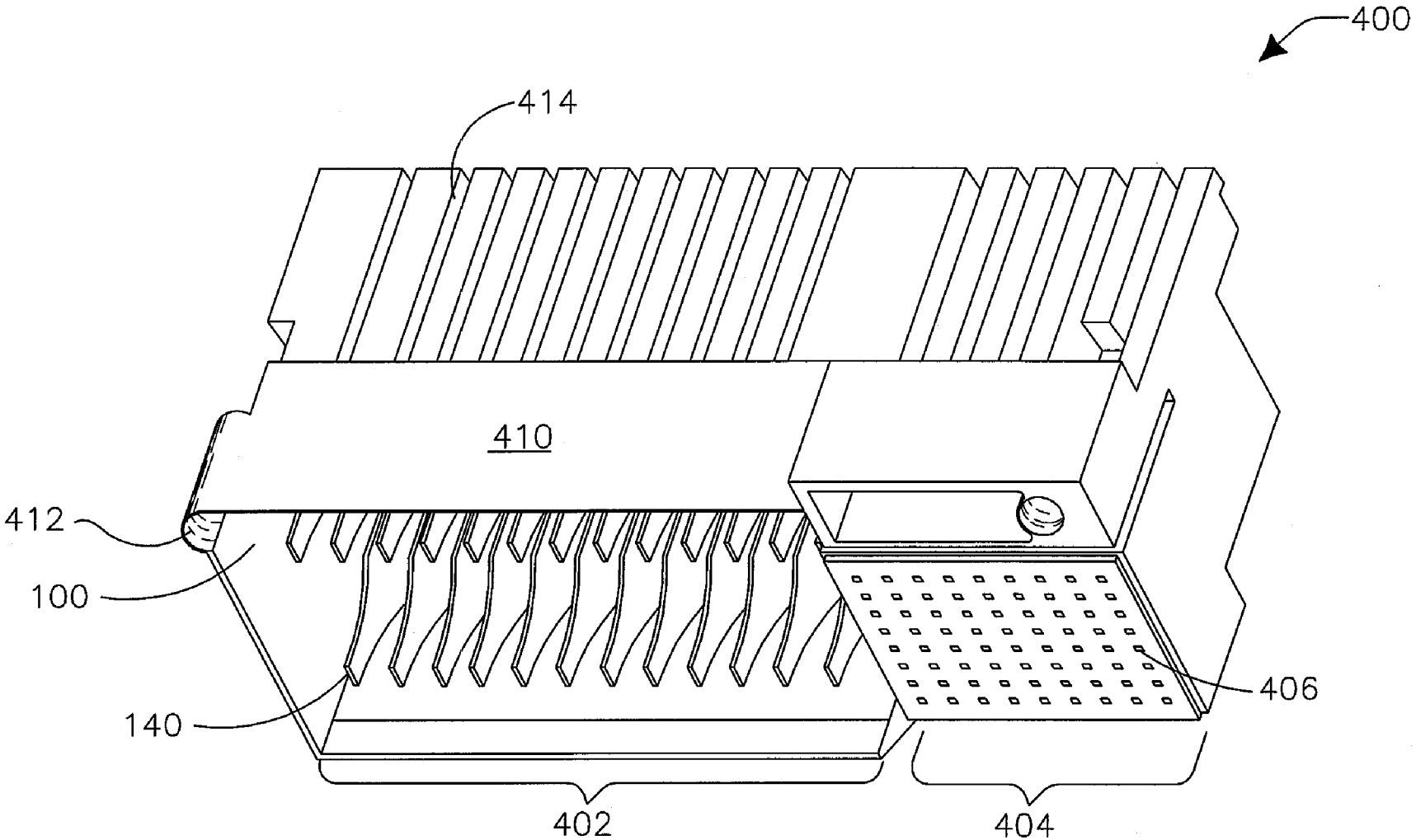
FIG. 5 depicts an example electrical connector comprising power contacts according to one aspect of the invention.

FIG. 5 depicts a top perspective view of a first connector 400 that may be used with the power contacts 100, 140 disclosed herein The connector 400 may comprise a power portion 402 and a signal portion 404, as this exemplifies a connector that complies with the μTCA standard. The connector 400 may include a connector housing 410, which may be made of dielectric material, such as plastic. The first connector 400 shown is typically referred to as a receptacle connector because the signal portion 404 receives signal contacts.

A uTCA-compliant connector meets the density requirement of 24 hot-pluggable 12-A power contacts and 72 signal contacts within 63.5 mm. A design element of the μTCA connector that enables the contact density is a second row of power contacts. The connector in FIG. 5 incorporates 24 power contacts located in two rows. The first row may include a row of single power contacts 140, as described with regard to FIG. 1. The first row of contacts 140 contained in the connector housing 410 may be positioned in a bottom row in the connector housing. Each contact 140 in the first row includes a single beam portion, as shown in FIG. 1B. The first row of contacts 140 may be positioned broadside to broadside relative to one another in the housing. The tapered tab portion 120 extends from a mating end 104 of the single beam portion and at least one terminal pin (not shown) extends from an edge of the single beam portion.

The second row may include power contacts 100, as described with regard to FIG. 1. The second row of contacts 100 may be contained in the top row in the connector housing. FIG. 5 depicts a tip of the tab portion 120 of power contacts 100, as shown in FIG. 1.

The first connector 400 may include grooves 414 in which the power contacts 100, 140 may be inserted. For example, each power contact 100, 140 may be slid or press-fit into a groove 414 to secure the contact within the housing. The groove 414 thereby provides support and stability of the contact position inside the housing.

The plurality of power contacts 100, 140 that extend along the connector housing 410 in two rows provide a mating region for electrically connecting to a second connector. The mating ends of the power contacts 100, 140 shown housed in the connector housing 410 may be mated to a plurality of complementary receptacle contacts disposed in a second connector housing (described herein with regard to FIG. 6).

Proper alignment aids the engagement of the mating connectors. The alignment feature that is uTCA compliant includes an alignment cavity 412 that may receive an alignment post of a mating connector. The alignment cavity 412 may have any shape suitable for receiving an alignment post. FIG. 5 depicts an alignment cavity that is circular.

The example embodiment of the first connector 400 in FIG. 5 includes a signal portion 404. The signal portion 404 may comprise an array of signal contact apertures 406 that are adapted for receiving respective mating signal contact protrusions of a second connector. FIG. 5 depicts two example signal contact protrusions 408 received by the signal portion 404.

The power contacts 100, 140 described herein may be used in μTCA-compliant interconnect applications. However, various configurations of a first connector may be used with the power contacts 100, 140. For example, the first connector 400 need not include a signal portion 404. Also, the first connector 400 may house more or less than 24 power contacts. The power contacts 100, 140 may be disposed in the first connector 400 in more or less than two rows.

The first connector 400 shown in FIG. 5 is a right angle connector. The terminal portions (not shown) that may extend from each of the power contacts 100, 140 contained in the housing 410 of the first connector 400 may be electrically connected to another electrical component. If the power contacts 100, 140 of FIG. 1 are disposed in the housing 410, the terminal portions 126, 148 of respective power contacts 100, 140 may extend from the first connector housing 410 substantially perpendicular to a mating face. The design of the first connector 400 and power contacts 100, 140 may be such that the terminal portions extend from the first connector 400 in a different direction. For example, the terminal portions may extend outward from the first connector housing 410 opposite to the mating face. Such a design would be suitable for mezzanine interconnect applications.

Figure 6:
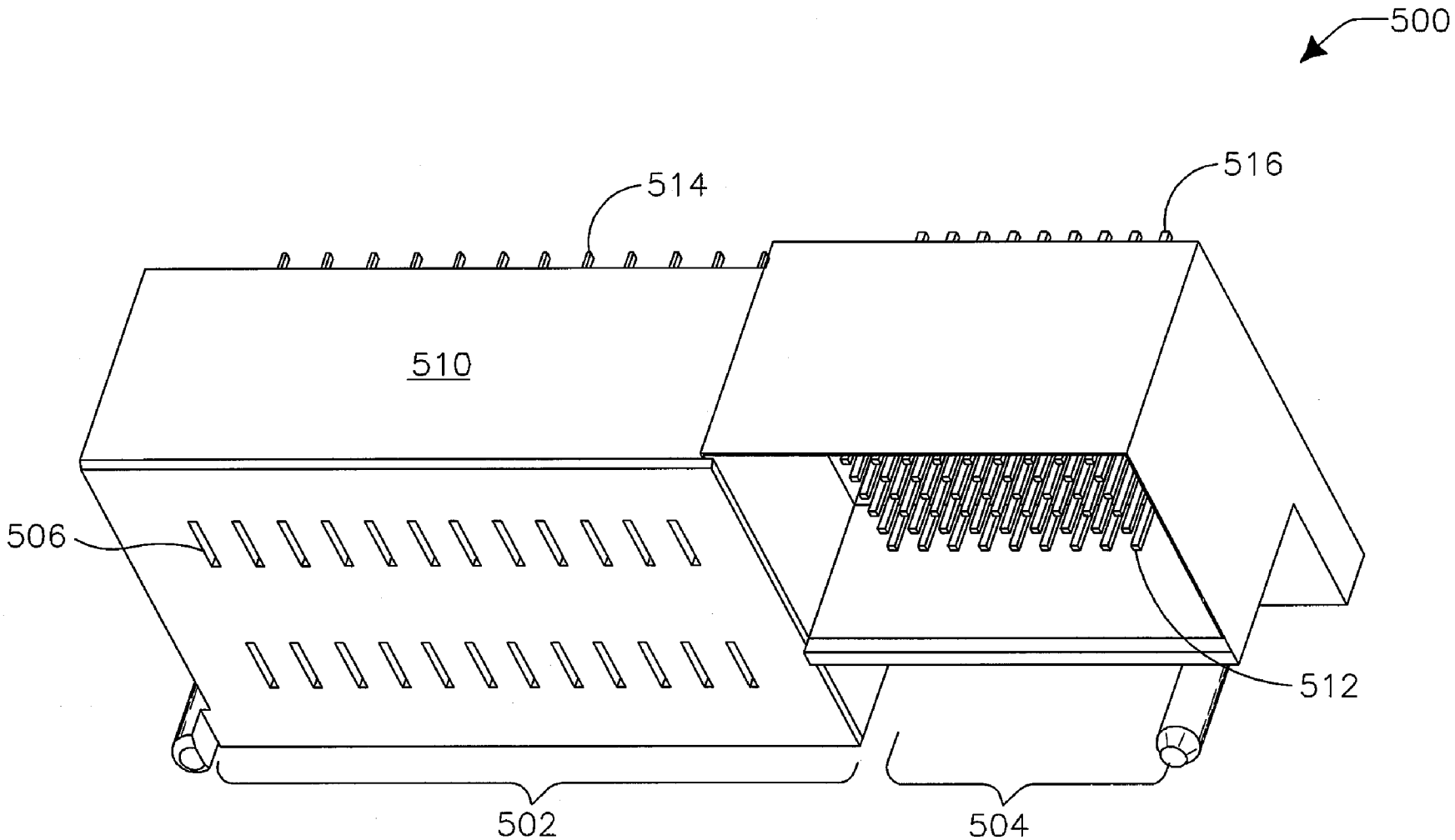
FIG. 6 depicts a receptacle electrical connector adapted to mate with the electrical connector depicted in FIG. 5.

FIG. 6 depicts a second connector 500 that is a complementary connector to the first connector 400 of FIG. 5. In compliance with the μTCA standard, the second connector shows both a complementary power portion 502 and a complementary signal portion 504. The complementary power portion 502 of the second connector may have 24 apertures 506 in two rows. The power portion 502 may have one row or more than two rows of apertures 506. Each aperture may correspond to each of the 24 respective mating contacts of the μTCA-compliant first connector. Each power contact aperture 506 may extend there through in the front to back direction of the housing of the second connector 510. Inside each aperture there may be a receptacle contact (not shown) that may mate with the power contacts 100, 140 as the power contacts 100, 140 are inserted into the connector. The receptacle contacts disposed in the second connector housing may be one of those shown in FIGS. 2A-2C or 3A-3C.

When the first connector 400 is mated to a complementary second connector, such as 500, each blade portion of each power contact 100, 140 may be inserted into a separate power contact aperture 506 of the second connector 500. Each blade portion may extend into the apertures 506 of the second connector 500 and may be received by receptacle contacts disposed in each aperture 506. The signal protrusions 512 on the second connector may be likewise received by the signal apertures 506 of the first connector.

The tail portions 514 of the receptacle contacts that are disposed inside the housing 510 extend outward from the rear of the housing. The tail portions depicted in FIG. 6 may correspond to the tail portions 222 shown in FIGS. 2A-2C or to the tail portions 322 shown in FIGS. 3A-3C. Tail portions of the signal portions 516 may also extend outward from the rear of the housing. The tail portions, 514 and 516, may collectively be electrically connected to a substrate, such as a printed circuit board.

What is claimed is:

1. A power contact, comprising:

a body portion; and a tab portion extending from a first end of the body portion, the tab portion having a first width at the first end of the body portion and a second width at a distal end of the tab portion, wherein the tab portion includes a width-reducing curved surface that is disposed between the first end of the body portion and the distal end of the tab portion such that the second width is less than the first width.

2. The power contact of claim 1, wherein the body portion comprises a single beam.

3. The power contact of claim 1, wherein the body portion comprises a first beam extending along a first direction and a second beam extending from the first beam in a second direction that is different from the first direction.

4. The power contact of claim 3, wherein the second direction is perpendicular to the first direction.

5. The power contact of claim 1, further comprising at least one terminal pin that extends from an edge of the body portion.

6. The power contact of claim 3, wherein the tapered tab portion extends from the first beam, the power contact further comprising at least one terminal pin that extends from the second beam.

7. The power contact of claim 1, wherein the body portion defines first and second opposing edges, the first end of the body portion extends from the first edge to the second edge and defines a distance from the first edge to the second edge, and the first width of the tab portion is equal to the distance from the first edge to the second edge.

8. The power contact of claim 1, wherein the body portion defines first and second opposing edges, the first end of the body portion extends from the first edge to the second edge and defines a distance from the first edge to the second edge, and the first width of the tab portion is different from the distance from the first edge to the second edge.

9. The power contact of claim 1, further comprising a retention boss disposed on the body portion.

10. An electrical connector comprising:

a connector housing defining a mating end and a mounting end;

a row of power contacts extending from the mounting end, and a tapered tab portion extending from the mating end, the tapered tab portion defining a body having a proximal end disposed at the mating end, and an opposing distal end, wherein that the body curves inward at a location between the proximal end and the distal end such that the proximal end is wider than the distal end.

11. The electrical connector of claim 10, wherein the power contacts are positioned broadside-to broadside relative to one another.

12. The electrical connector of claim 10, wherein each of the power contacts is positioned edge-to-edge relative to a respective one of the second contacts.

13. The electrical connector of claim 10, wherein each said tapered tab portion tapers from a first, relatively wide end to a second, relatively narrow distal end.

14. The electrical connector of claim 13, wherein each said tapered tab portion tapers curvilinearly from the wide end to the narrow end thereof.

15. A power contact, comprising:

a body portion defining a mating end disposed at an outer end of the body portion; and a tab portion extending in a first direction from the mating end to a distal end such that the body portion does not extend beyond the distal end with respect to the first direction, wherein the tab portion defines opposing curved side walls disposed between the mating end and the distal end.

16. The power contact of claim 15, wherein the body portion further comprises a mounting end having at least one terminal pin.

17. The power contact of claim 16, wherein the terminal pin extends from the body portion in a direction that is perpendicular to the mating end.

18. The power contact of claim 15, further comprising a retention boss disposed on the body portion, wherein the retention boss is adapted to retain the contact in a connector housing.

19. The power contact of claim 1, wherein the curved surface defines a concavity in the body portion.

20. The power contact of claim 1, wherein the curved surface is a continuous curved surface that is connected to both the first end of the body portion and the distal end of the tab portion.

21. The power contact of claim 1, wherein the body portion further comprises opposing upper and lower surfaces each extending between the first end of the body portion and the distal end of the tab portion, and a pair of side walls connected between the upper and lower surfaces, wherein each side wall is curved at a location between the first end of the body portion and the distal end of the tab portion.

22. The power contact of claim 21, wherein each side wall is curved from the first end of the body portion to the distal end of the tab portion.

23. The power contact of claim 22, wherein an entirety of each side wall defines a concavity in the body portion between the first end of the body portion and the distal end of the tab portion.

24. The electrical connector of claim 10, wherein the body curves inward from the mating end of the body portion along a direction away from the mating end.

25. The electrical connector of claim 24, wherein the body curves inward from the proximal end to the distal end.

26. The electrical connector of claim 10, wherein the body defines opposing surfaces that curve inward from the proximal end to the distal end.

27. The electrical connector of claim 26, wherein each of the opposing surfaces defines a concavity in the body.

28. The power contact of claim 15, wherein the opposing side walls are curved so as to define respective concavities in the tab portion.

29. The power contact of claim 15, wherein the concavity extends from the mating end to a distal end of the tab portion.

30. The power contact of claim 15, wherein the side walls define outer ends of the tab portion such that no part of the tab portion extends beyond the side walls with respect to a second direction that is perpendicular with respect to the first direction.

31. A power contact, comprising:

a power contact body having a length and a width that extend in perpendicular directions that define a plane;

a tab portion extending from the power contact body, the tab portion defining a proximal end connected to the power contact body and an opposing distal end having a width less than that of the proximal end, the tab portion further including a transition zone connected between the proximal and distal ends, wherein the transition zone defines a first transition section and a second transition section, the first transition section is disposed closer to the proximal end than the first transition section, and the first transition section has a width-reducing slope along a direction from the proximal end toward the distal end;

wherein the transition zone defines an intermediate location disposed between the first and second transition sections, such that a first straight line extending from the first transition section to the intermediate location defines a non-zero angle with respect to a second straight line extending from the second transition section to the intermediate location, and the first and second straight lines extend parallel to the plane.

32. The power contact of claim 31, wherein the distal end of the tab portion defines a terminal end of the power contact.

33. The power contact of claim 31, wherein the non-zero angle is between 90 degrees and 180 degrees.

34. The power contact of claim 31, wherein the transition zone is connected to the proximal end and the distal end.

35. The power contact of claim 31, wherein the power contact body comprises a first beam connected to the tab portion, and a second beam that extends from the first beam in a direction substantially perpendicular to the first beam, such that the power contact is a right- angle power contact.

36. The power contact of claim 35, wherein the first beam defines first and second opposing ends, the tab portion extends from the first end of the first beam, and the second beam extends from the second end of the first beam.

37. The power contact of claim 31, wherein the transition zone comprises opposing outer walls, such that a first straight line extending from the first transition section of each wall to the intermediate location of each wall defines a non-zero angle with respect to a second straight line extending from the second transition section of each wall to the intermediate location of each wall.

38. The power contact of claim 31, wherein the transition zone defines a linear taper disposed between the proximal end and the distal end.

39. The power contact of claim 31, wherein the first and second straight lines lie on the plane.

40. The power contact of claim 39, wherein the power contact body length is greater than the width, the power contact body further includes a thickness that extends along a direction that is perpendicular to those of the length and width, the length is greater than the width, and the width is greater than the thickness.

41. The power contact of claim 31, wherein the first transition section is connected to the proximal end, and the second transition section is connected to the distal end.

42. The power contact of claim 31, wherein the intermediate location is disposed at an interface between the first and second transition sections.

43. A power contact, comprising:

a beam having a length extending along a first direction, a width extending along a second direction that is perpendicular to the first direction, and a thickness extending along a third direction that is perpendicular to both the first and second directions, wherein the length is greater than the width, and the width is greater than the thickness; and a tab extending from the beam, the tab including:

a proximal end connected to the beam, and an opposing distal end, wherein the proximal end defines a first width extending along the second direction, the distal end defines a second width extending along the second direction, and the first width is greater than the second width;

a first wall and a second wall that opposes the first wall, wherein each wall are connected to the proximal and distal ends;

a first tab portion and a second tab portion, wherein the first tab portion is disposed closer to the proximal end than the second tab portion, and the second tab portion is disposed closer to the distal end than the first tab portion;

wherein the tab defines a first pair of points on the first wall at the first tab portion, and a second pair of points on the first wall at the second tab portion, wherein a first line that includes the first pair of points defines a first angle with respect to the second direction, and a second line that includes the second pair of points defines a second angle with respect to the second direction, and the second angle is greater than the first angle.

44. The power contact of claim 43, wherein the tab extends from the beam along the first direction.

45. The power contact of claim 43, wherein the beam is a first beam, and the power contact further comprises a body that includes the first beam and further includes a second beam, wherein the second beam extends from the first beam along the second direction such that the power contact is a right-angle power contact.

46. The power contact of claim 45, wherein the first beam defines first and second opposing ends along the first direction, the tab portion extends from the first end of the first beam, and the second beam extends from the second end of the first beam.

47. The power contact of claim 43, wherein the first and second lines lie on a plane defined by the beam.

48. The power contact of claim 47, wherein the first and second walls define a linear taper disposed between the proximal end and the distal end.

* * * * *